US007889845B2

(12) United States Patent
Harding

(10) Patent No.: US 7,889,845 B2
(45) Date of Patent: Feb. 15, 2011

(54) SECONDARY COLLIMATOR AND METHOD OF ASSEMBLING THE SAME

(75) Inventor: Geoffrey Harding, Hamburg (DE)

(73) Assignee: Morpho Detection, Inc., Newark, CA (US)

( * ) Notice: Subject to any disclaimer, the term of this patent is extended or adjusted under 35 U.S.C. 154(b) by 718 days.

(21) Appl. No.: 11/961,527

(22) Filed: Dec. 20, 2007

(65) Prior Publication Data

US 2010/0254516 A1 Oct. 7, 2010

(51) Int. Cl.
*G21K 1/00* (2006.01)

(52) U.S. Cl. ..... 378/154

(58) Field of Classification Search ..... 378/147–155
See application file for complete search history.

(56) References Cited

U.S. PATENT DOCUMENTS 6,704,390 B2 3/2004 Kogan
7,065,175 B2 6/2006 Green
7,274,768 B2 9/2007 Green
2005/0281383 A1 12/2005 Harding et al.
2006/0251215 A1 11/2006 Cernik
2008/0118033 A1 * 5/2008 Klausz ..... 378/154

* cited by examiner

*Primary Examiner*—Irakli Kiknadze
(74) *Attorney, Agent, or Firm*—Armstrong Teasdale LLP

(57) ABSTRACT

A method for assembling a secondary collimator including a first face plate having a first surface and an opposing second surface is provided. The method includes positioning a lamella assembly on the first face plate, wherein the lamella assembly includes at least one radiation-absorbing material layer and at least one radiation-transmitting material layer, such that a first surface of the lamella assembly is adjacent the second surface of the first face plate. The method also includes coupling a second face plate to the first face plate and the lamella assembly such that a first surface of the second face plate is adjacent a second surface of the lamella assembly.

20 Claims, 4 Drawing Sheets

SECONDARY COLLIMATOR AND METHOD OF ASSEMBLING THE SAME

FIELD OF THE INVENTION

The field of the invention relates generally to a collimators for use in X-ray imaging systems and, more particularly, to a secondary collimator for use with an X-ray diffraction imaging (XDI) system.

BACKGROUND OF THE INVENTION

Known security detection devices are used at travel checkpoints to inspect carry-on and/or checked bags for concealed weapons, narcotics, and/or explosives. At least some known security devices utilize X-ray imaging for screening luggage. For example, XDI systems provide an improved discrimination of materials, as compared to that provided by the X-ray baggage scanners, by measuring d-spacings between lattice planes of micro-crystals in materials. A "d-spacing" is a spacing between adjacent layer planes in a crystal.

A checkpoint screening system with XDI using an inverse fan-beam geometry (a large source and a small detector) and a multi-focus x-ray source (MFXS) has been proposed. To reduce the size of the MFXS in such systems, a greater number of detector elements are required. At least one known XDI system includes a secondary collimator defined by an array of slits in a series of high Z (tungsten alloy) baffles. A "high Z" material is a material having a high atomic number, such as, for example, tungsten (Z=74), platinum (Z=78), gold (Z=79), lead (Z=82), and/or uranium (Z=92). However, such a secondary collimator does not permit the number of detector elements to be increased because the baffles cannot be fabricated to include a high number of slits without the operability of the secondary collimator being adversely affected. Moreover, such known secondary collimators are difficult and expensive to manufacture because the collimators are fabricated from tungsten alloy.

Known aluminum composite panel (ACP) is used for advertising signs, external walls, curtain boards, recoating for external walls, roofs, private rooms, internal decoration of sound-insulated rooms, advertising boards, automobile skins, and/or internal and external boat decoration. FIG. 4 shows an exploded perspective view of a known aluminum composite panel (ACP). A conventional ACP sheet 300 includes an inner foam core 302 of EPS with a honeycomb geometry. An aluminum skin 304 is coupled to each length-and-height-wise surface 306 and 308 of foam core 302 with adhesive 310 to form ACP sheet 300.

BRIEF DESCRIPTION OF THE INVENTION

In one aspect, a method for assembling a secondary collimator including a first face plate having a first surface and an opposing second surface is provided. The method includes positioning a lamella assembly on the first face plate, wherein the lamella assembly includes at least one radiation-absorbing material layer and at least one radiation-transmitting material layer, such that a first surface of the lamella assembly is adjacent the second surface of the first face plate. The method also includes coupling a second face plate to the first face plate and the lamella assembly such that a first surface of the second face plate is adjacent a second surface of the lamella assembly.

In another aspect, a secondary collimator is provided. The secondary collimator includes a first face plate, a second face plate, and a lamella assembly coupled between the first face plate and the second face plate. The lamella assembly includes at least one lamella, wherein each said lamella includes at least one radiation-absorbing material layer and at least one radiation-transmitting material layer.

In still another aspect, an X-ray diffraction imaging (XDI) system is provided. The system includes an X-ray source, a detector array including a plurality of detector elements, and a secondary collimator coupled between the X-ray source and the detector array. The secondary collimator includes a first face plate, a second face plate, and a lamella assembly coupled between the first face plate and the second face plate. The lamella assembly includes at least one lamella, wherein each lamella includes at least one radiation-absorbing material layer and at least one radiation-transmitting material layer.

BRIEF DESCRIPTION OF THE DRAWINGS

FIG. 1 is a schematic cross-sectional view of an exemplary X-ray diffraction imaging (XDI) system.

FIG. 2 is a schematic cross-sectional view of an exemplary secondary collimator suitable for use with the XDI system shown in FIG. 1.

FIG. 3 is a schematic cross-sectional view of an alternative exemplary secondary collimator suitable for use with the XDI system shown in FIG. 1.

FIG. 4 is an exploded perspective view of a prior art aluminum composite panel suitable for with the secondary collimator shown in FIG. 2.

FIG. 5 is a flowchart of an exemplary method for assembling the secondary collimator shown in FIG. 2.

DETAILED DESCRIPTION OF THE INVENTION

While described in terms of detecting contraband including, without limitation, weapons, explosives, and/or narcotics, within baggage, the embodiments described herein can be used for any suitable XDI application. Furthermore, the term "parallel" as used herein refers to planes, lines, curves, and/or layers that are equidistantly spaced apart and never intersect each other.

Figure 1:
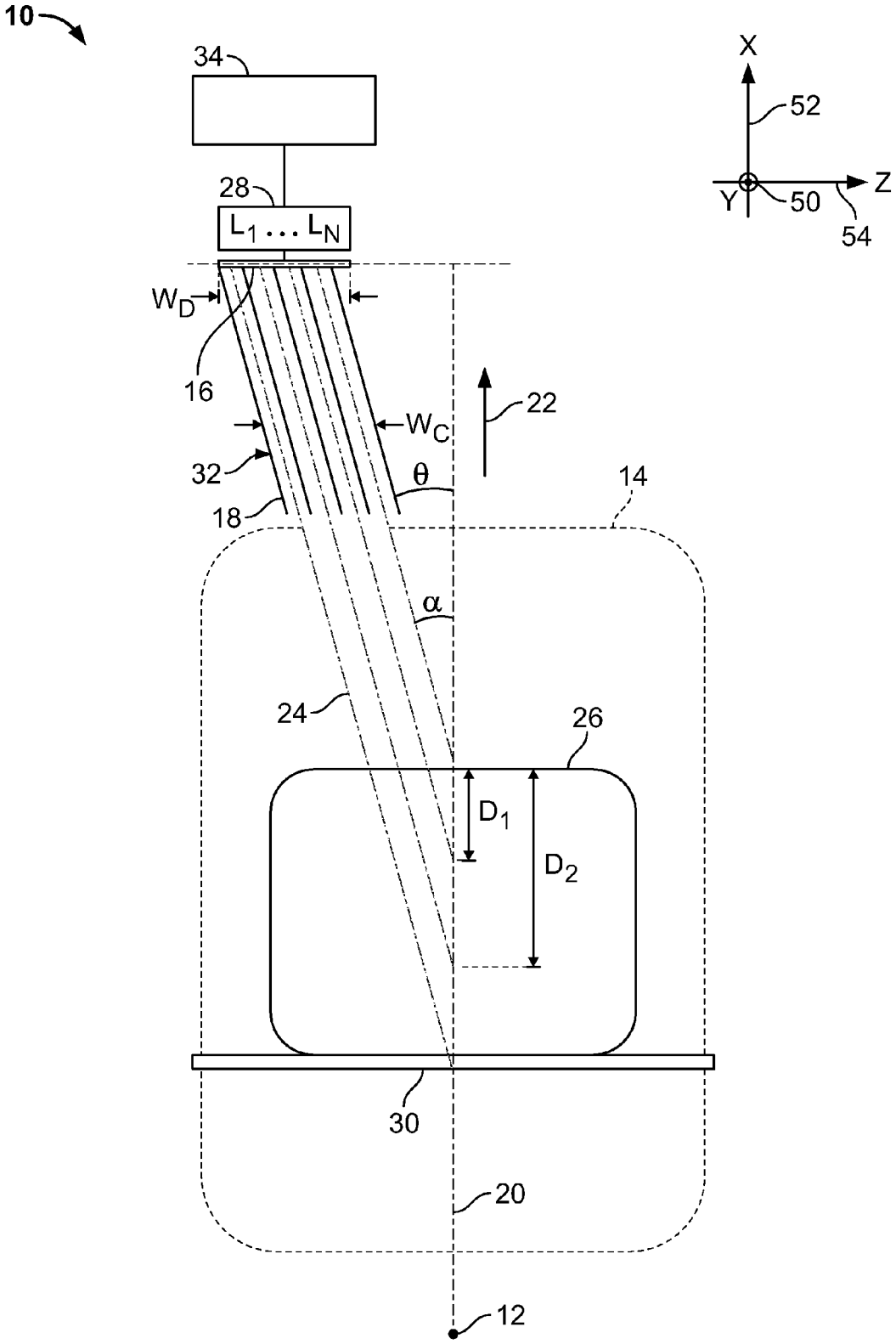
FIGS. 1-5 show exemplary embodiments of the systems and methods described herein.

FIG. 1 is a schematic cross-sectional view, in an X-Z plane, of an exemplary embodiment of an X-ray diffraction imaging (XDI) system 10. In the exemplary embodiment, XDI system 10 includes an X-ray source 12, an examination area 14 shown by phantom lines in FIG. 1, a detector array 16, and a secondary collimator 18. X-ray source 12, in the exemplary embodiment, is a multi-focus X-ray source (MFXS) that is movable along a Y-axis 50 and emits an X-ray beam 20 along an X-axis 52 such that a direction 22 of X-ray beam 20 is substantially parallel to the X-axis 52. As such, X-ray source 12 moves in a direction substantially perpendicular to direction 22 of X-ray beam 20.

In the exemplary embodiment, detector array 16 is a one-dimensional or two-dimensional pixellated detector array. Alternatively, detector array 16 is a strip detector. In the exemplary embodiment, detector array 16 extends either along a Z-axis 54 or along Z-axis 54 and Y-axis 50 such that X-ray beam 20 is substantially perpendicular to detector array 16. Furthermore, in the exemplary embodiment, detector array 16 has a width $W_D$ of approximately 20 mm such that each pixel (not shown) is approximately 1 $mm^2$ and includes more than fourteen detector elements (not shown). Alternatively, detector array 16 has any width and/or number of detector elements that enables XDI system 10 to function as described herein. In the exemplary embodiment, detector array 16 is configured to detect scattered radiation 24 passing through an object 26. Furthermore, in the exemplary embodiment, detector array 16 includes a number of channels 28, for example, N number of channels $C_1, \ldots C_N$, wherein N is selected based on the configuration of system 10.

In the exemplary embodiment, examination area 14 is at least partially defined by a support 30 configured to support object 26 within examination area 14. More specifically, in the exemplary embodiment, object 26 is baggage, luggage, cargo, and/or any other container in which contraband, such as explosives and/or narcotics, may be concealed. Support 30 may be a conveyor device, a table, and/or any other suitable support for object 26. Although in the exemplary embodiment, support 30 is positioned between object 26 and X-ray source 12, support 30 may be positioned between object 26 and detector array 16.

Secondary collimator 18, in the exemplary embodiment, is positioned between detector array 16 and object 26 and has a length (not shown) along Y-axis 50 and a width $W_C$ along Z-axis 54. In the exemplary embodiment, secondary collimator 18 includes a lamella assembly 32 that is oriented at an angle θ to X-ray beam 20. Lamella assembly 32 is configured to facilitate ensuring that scattered radiation 24 arriving at detector array 16 has a constant scatter angle α with respect to X-ray beam 20 and that a position of detector array 16 permits determination of a depth, such as $D_1$ and/or $D_2$, in object 26 at which the polychromatic X-ray scattered radiation 24 (hereinafter "scattered radiation 24") originated. For example, lamella assembly 32 is arranged parallel to a direction of scattered radiation 24 to absorb scattered radiation (not shown) that is not parallel to the direction of the scattered radiation 24. More specifically, lamella assembly 32 is arranged such that angle θ is approximately equal to angle α, wherein neither angle θ nor angle α is parallel to direction 22 of X-ray beam 20. Furthermore, although, in the exemplary embodiment, secondary collimator 18 is positioned on one side of X-ray beam 20 with respect to Z-axis 54, secondary collimator 18 may be positioned on both sides of X-ray beam 20 with respect to Z-axis 54.

During operation, XDI system 10 implements an inverse fan geometry to measure scattered radiation 24 from object 26 at a substantially constant in-plane angle α. More specifically, X-ray source 12 emits X-ray beam 20 substantially parallel to X-axis 52. X-ray beam 20 passes through object 26 within examination area 14. As X-ray beam 20 passes through object 26, radiation is scattered at a range of angles to X-ray beam 20. At least some of the radiation is scattered radiation 24 at angle α to X-ray beam 20. Scattered radiation 24 passes through lamella assembly 32 of secondary collimator 18 and is detected by detector array 16. Data collected by detector array 16 is transmitted through channels 28 to a control system 34 for further processing. In one embodiment, such processing identifies a material (not shown) of object 26 using d-spacings between lattice planes of micro-crystals in the material, as described above.

Figure 2:
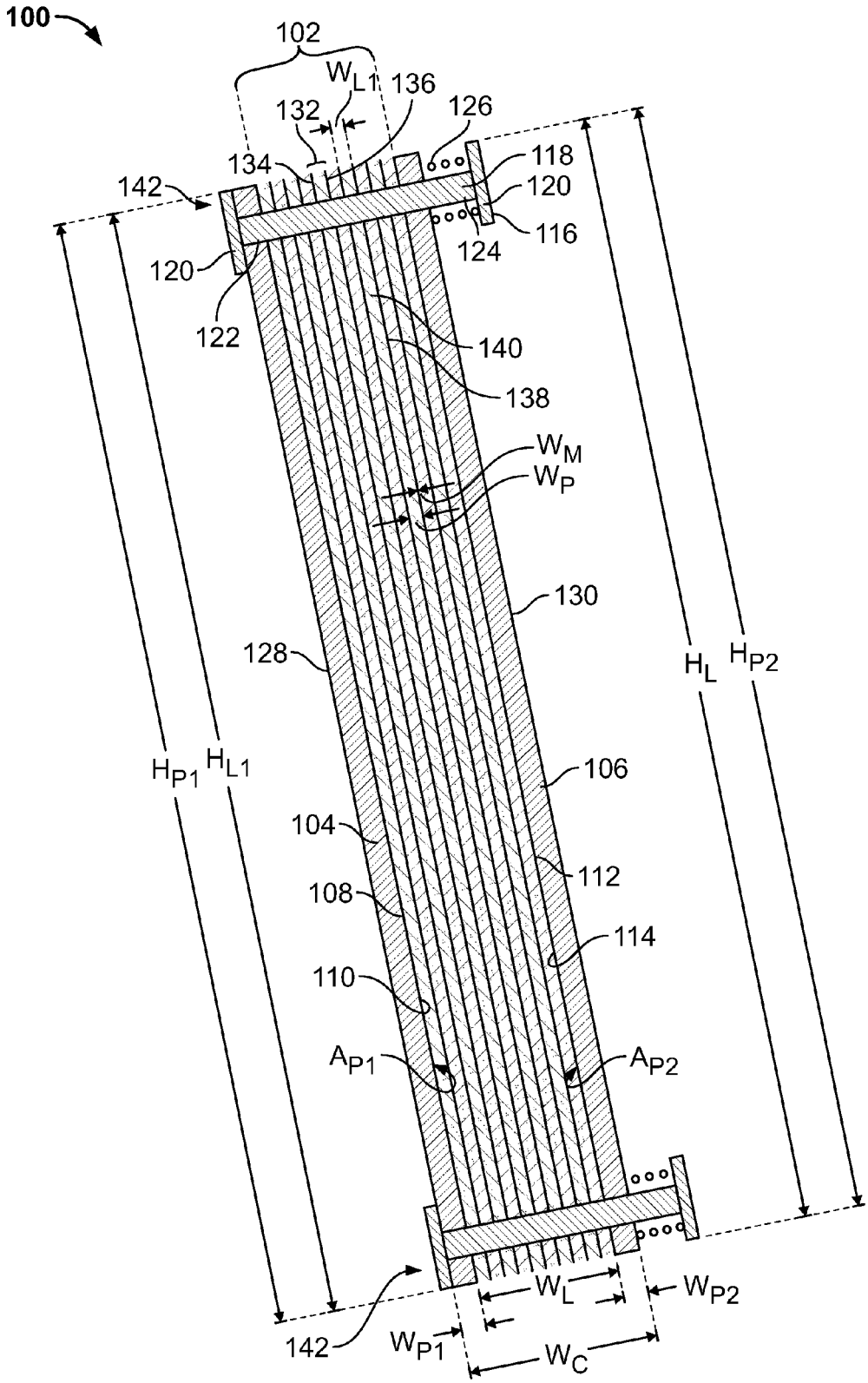
Figure 3:
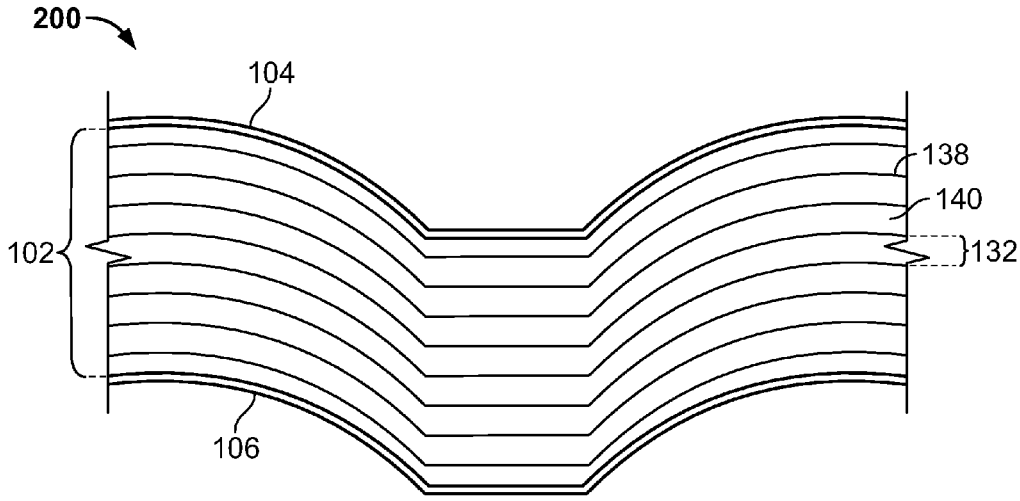

FIG. 2 is a schematic cross-sectional view of an exemplary secondary collimator 100 suitable for use as secondary collimator 18 in system 10. FIG. 3 is an alternative exemplary secondary collimator 200 suitable for use as secondary collimator 18 in system 10. Secondary collimator 200 is substantially similar to secondary collimator 100 with the exception that secondary collimator 200 is at least partially non-planar in profile, rather than having the substantially planar profile of secondary collimator 100. Because secondary collimators 100 and 200 are substantially similar, for simplicity, only secondary collimator 100 will be described in detail, unless otherwise described.

In one exemplary embodiment, secondary collimator 100 includes a lamella assembly 102, a first face plate 104, and a second face plate 106. In the exemplary embodiment, lamella assembly 102 is an assembly that attenuates a portion of radiation and is substantially transparent to another portion of radiation. More specifically, in the exemplary embodiment, lamella assembly 102 is an assembly that includes at least one radiation-absorbing material layer and at least one radiation-transmitting material layer, as described in more detail below. As used herein the term "radiation-transparent material" includes materials that allow a relatively large amount of radiation to pass therethrough, and the term "radiation absorbing material" includes materials that absorb and/or attenuate a relatively large amount of radiation that is directed to the material. Furthermore, as used herein "radiation-absorbing layer," "radiation-attenuating layer," "X-ray attenuating layer," and variations thereof, may be used interchangeably with "metal layer" although a radiation-absorbing layer may be other than metal, and "radiation-transmitting layer," "radiation-transparent layer," "non-X-ray attenuating layer," "X-ray transparent layer," and variations thereof, may be used interchangeably with "porous material layer" although a radiation-transparent layer may be other than porous material.

In the exemplary embodiment, lamella assembly 102 is coupled between first face plate 104 and second face plate 106 such that a first surface 108 of lamella assembly 102 is adjacent an inner surface 110 of first face plate 104, and a second surface 112 of lamella assembly 102 is adjacent an inner surface 114 of second face plate 106. First face plate 104, second face plate 106, and lamella assembly 102 are coupled together using mechanical fasteners, chemical processes, and/or any suitable fastening technique and/or mechanism that enables secondary collimator 100 to function as described herein. One example of a mechanical fastener is clamps 116. As further explained below, each clamp 116 may include a biasing member 126 that applies pressure to the lamella once the secondary collimator 100, 200 is assembled. In the exemplary embodiment, each clamp 116 includes a bar 118 having a first end 122 and a second end 124. A retaining nut 120 may be coupled to the first end 122 of the bar 118. Another retaining nut 120 may be coupled to the second end 124 of the bar 118. A portion of the bar 118 may be threaded. A biasing member 126, such as a spring, may be operatively coupled to bar 118 between first face plate 104 and/or second face plate 106 and respective retaining nut 120. The secondary collimator 100 and/or 200 may include X clamps 116, where X is a number. In the exemplary embodiment, secondary collimator 100 and/or 200 includes a clamp 116 at each corner 142 of secondary collimator 100 and/or 200.

First face plate 104 has a length (not shown), a width $W_{P1}$, and a height $H_{P1}$. Similarly, second face plate 106 has a length (not shown), a width $W_{P2}$, and a height $H_{P2}$. In the exemplary embodiment, the length of first face plate 104 and the length of second face plate 106 are substantially equal, and height $H_{P1}$ and height $H_{P2}$ are substantially equal. In one embodiment, the lengths are between approximately 0.5 m and approximately 1.0 m, and heights $H_{P1}$ and $H_{P2}$ are each approximately 500 mm. Alternatively, the dimensions of first face plate 104 and/or second face plate 106 are selected based on the configuration of system 10. Furthermore, first face plate 104 and second face plate 106 each has a predetermined profile. In the exemplary embodiment, first face plate 104 and second face plate 106 are substantially planar. Alternatively, as shown in FIG. 3, at least a portion of first face plate 104 and/or a least a portion of second face plate 106 are substantially non-planar such that first face plate 104 and/or second face plate 106 is at least partially non-planar. As such, secondary collimator 200 has an at least partially non-planar profile. In one embodiment, the profile is selected based on the configuration of X-ray source 12 (shown in FIG. 1). In the exemplary embodiment, inner surface 110 of first face plate 104 and inner surface 114 of second face plate 106 have the same or similar profile within a precision of approximately 10 μm over substantially all of a surface area $A_{P1}$ of inner surface 110 and a surface area $A_{P2}$ of inner surface 114.

In the exemplary embodiment, an outer surface 128 of first face plate 104 and/or an outer surface 130 of second face plate 106 is configured to maintain the profile of the respective first face plate 104 and/or second face plate 106. More specifically, outer surface 128 and/or outer surface 130 may include a configuration, such as ribs (not shown), that facilitates maintaining the planarity of the profile under a pressure force applied to outer surface 128 and outer surface 130. Moreover, each face plate 104 and 106 may be fabricated from steel and/or any other suitable material that enables secondary collimator 100 to function as described herein.

Lamella assembly 102, in the exemplary embodiment, is oriented at angle α to X-ray beam 20 (shown in FIG. 1), as described above. Lamella assembly 102 has a length (not shown), a width $W_L$, and a height $H_L$, wherein the width $W_L$ is measured from first surface 108 to second surface 112 of lamella assembly 102. In the exemplary embodiment, the length of lamella assembly 102 is substantially equal to the lengths of first face plate 104 and/or the length of second face plate 106, the height $H_L$ is substantially equal to heights $H_{P1}$ and/or $H_{P2}$, and the width $W_L$ is approximately 20 mm. Alternatively, lamella assembly 102 has any suitable dimensions that enable secondary collimator 100 to function as described herein. In one embodiment, width $W_L$ is selected based on width $W_D$ (shown in FIG. 1) and/or the number of elements of detector array 16 (shown in FIG. 1).

In the exemplary embodiment, lamella assembly 102 includes a plurality of lamellae 132. For example, lamella assembly 102 includes M number of lamellae $L_1, \ldots L_M$, wherein M is based on the configuration of system 10. More specifically, in the exemplary embodiment, the number M of lamellae 132 is equal to the number N of channels 28 (shown in FIG. 1). In an alternative embodiment, the number of lamellae M is any suitable number of lamellae 132 that enables system 10 to function as described herein. Each lamella 132 has a length (not shown), a width $W_{L1}$, and a height $H_{L2}$, wherein the width $W_{L1}$ is measured from a first surface 134 to a second surface 136 of lamella 132. In the exemplary embodiment, the length of the lamellae 132 is substantially equal to the length of first face plates 104 and/or the length of second face plates 106, and height $H_{L1}$ is substantially equal to heights $H_{P1}$ and/or $H_{P2}$. Furthermore, in the exemplary embodiment, width $W_{L1}$ is selected based on the number M of lamellae 132. In one embodiment, width $W_{L1}$ is approximately 1.0 mm. Each lamella 132, in the exemplary embodiment, is oriented at angle α to X-ray beam 20 such that each lamella 132 is substantially parallel to adjacent lamellae 132. Furthermore, lamellae 132 are oriented such that scattered radiation 24 (shown in FIG. 1) between neighboring lamellae 132 is incident on at least one detector element of detector array 16. In one embodiment, lamellae 132 are oriented such that scattered radiation 24 between neighboring lamellae 132 is incident on a corresponding detector element of detector array 16.

In the exemplary embodiment, each lamella 132 includes at least one layer that is substantially radiation-attenuating, such as a metal layer 138, and at least one layer that is substantially radiation-transparent or non-attenuating, such as a porous material layer 140. In an alternative embodiment, each lamella 132 includes two metal layers 138 and porous material layer 140 is coupled between metal layers 138. In the exemplary embodiment, each metal layer 138 is substantially parallel to each porous material layer 140, and vice versa. Metal layer 138 and porous material layer 140 are coupled together using adhesive bonding, chemical bonding, and/or any suitable coupling technique that enables secondary collimator 100 to function as described herein. In the exemplary embodiment, the porous material is a material that is transparent to X-ray radiation and that facilitates providing suitable strength to secondary collimator 100. For example, the porous material may include, without limitation, foam, expanded polystyrene (EPS), a material with a honeycomb geometry, and/or any suitable X-ray transparent material that enables secondary collimator 100 to function as described herein. In the exemplary embodiment, porous material layer 140 has a width $W_P$ that is approximately 0.5 mm.

Figure 4:
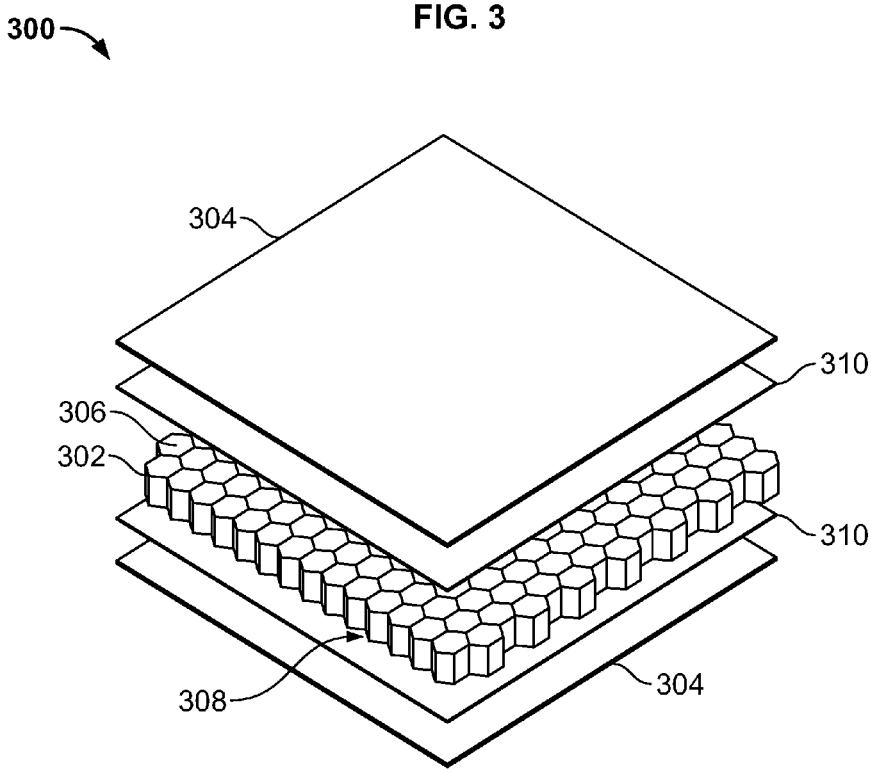
FIG. 4 (Prior Art)

Metal layer 138 includes, in the exemplary embodiment, a radiation-absorbing or radiation-attenuating material, such as, for example, aluminum (Al), copper (Cu), steel, and/or any suitable material that enables secondary collimator 100 to function as described herein. Furthermore, in the exemplary embodiment, metal layer 138 has a width $W_M$ that is smaller than the width $W_P$ of porous material layer 140. For example, width $W_M$ is between approximately 50 μm and approximately 500 μm. In the exemplary embodiment, width $W_M$ is approximately 100 μm. In one embodiment, each lamella 132 is a sheet 300 of aluminum composite panel (ACP), such as shown in FIG. 4, and described above.

Figure 5:
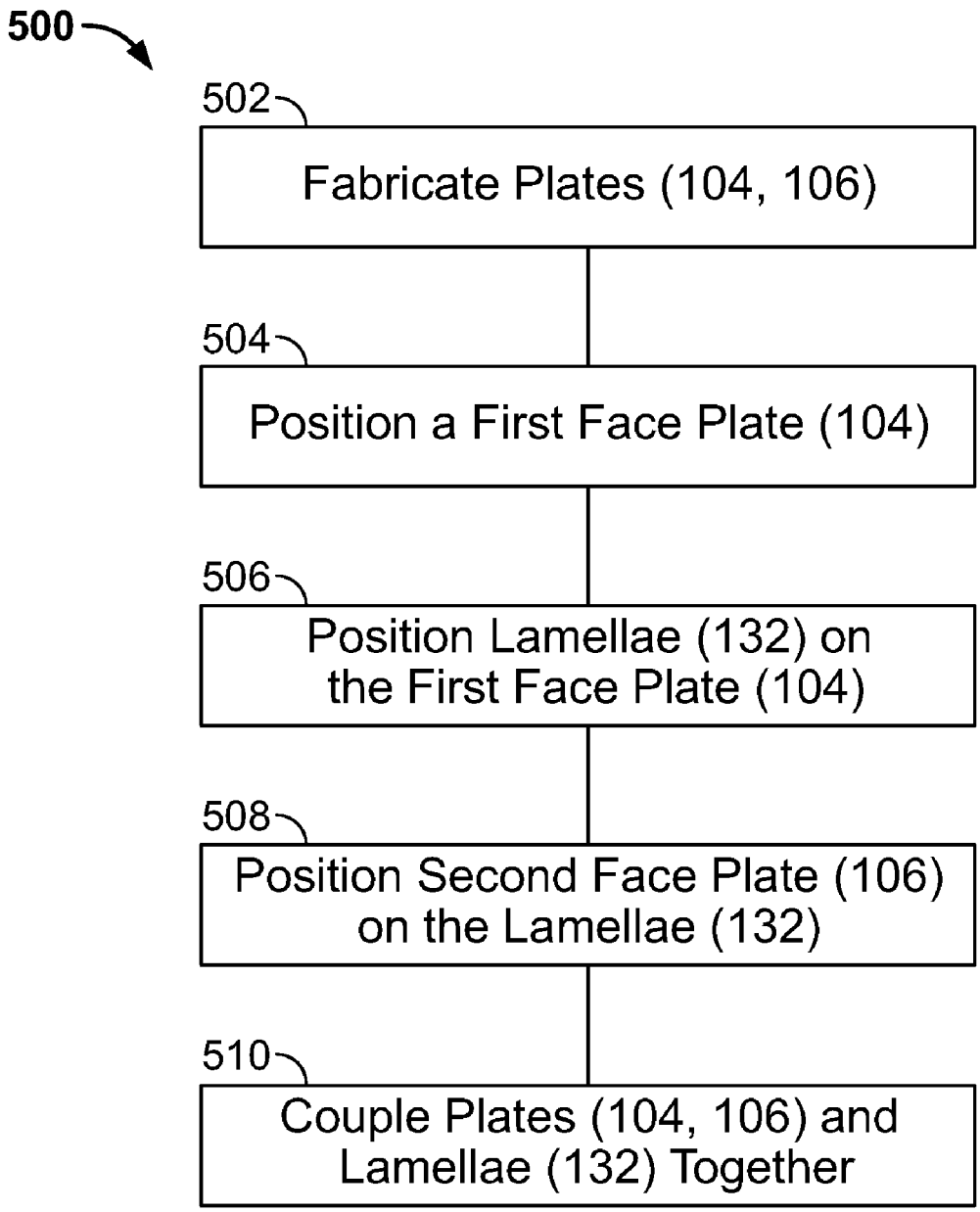

FIG. 5 is a flowchart 500 of an exemplary method for assembling secondary collimator 100 (shown in FIG. 2) and/or secondary collimator 200 (shown in FIG. 3). Unless otherwise indicated, one or more of the functions represented by blocks 502, 504, 506, 508, and 510 may be performed sequentially, concurrently, or in any suitable order. To assemble secondary collimator 100 and/or 200, first face plate 104 (shown in FIG. 2) is fabricated 502 using any suitable fabrication technique such that inner surface 110 (shown in FIG. 2) is within a tolerance of the predetermined profile. In the exemplary embodiment, inner surface 110 of first face plate 104 is fabricated 502 to within approximately 10 μm of being substantially planar. Furthermore, first face plate 104 is fabricated 502 such that outer surface 128 (shown in FIG. 2) is configured to facilitate strengthening and/or maintaining the predetermined profile of first face plate 104 and/or secondary collimator 100 and/or 200 during assembly and/or use. In the exemplary embodiment, outer surface 128 is fabricated 502 to include ribs (not shown). Similarly, inner surface 114 (shown in FIG. 2) of second face plate 106 (shown in FIG. 2) is fabricated 502 within a tolerance of the predetermined profile, and outer surface 130 (shown in FIG. 2) of second face plate 106 is configured to strengthen second face plate 106 and/or secondary collimator 100 and/or 200.

In the exemplary embodiment, first face plate 104 is positioned 504 horizontally on a support structure (not shown), such as a table (not shown). Alternatively, first face plate 104 is positioned other than horizontally. More specifically, in the exemplary embodiment, outer surface 128 of first face plate 104 is adjacent to the support structure and inner surface 110 is exposed and facing upwards. Next, in the exemplary embodiment, to position lamella assembly 102 (shown in FIG. 2) onto first face plate 104, a first lamellae 132 (shown in FIG. 2) of lamella assembly 102 is positioned 506 on inner surface 110 of first face plate 104. As such, at least one radiation-absorbing material layer or metal layer 138 and at least one radiation-transmitting material layer or porous material layer 140 is positioned 506 on first face plate 104. More specifically, the length and the height $H_{L1}$ of lamella 132 are generally aligned with the respective length and the height $H_{P1}$ of first face plate 104. An M-1 number of lamellae 132 are positioned 506 on the first lamella 132 such that lamellae 132 are generally aligned with each other and first face plate 104. As such, in the exemplary embodiment, lamellae 132 are assembled such that the length and the height $H_L$ of lamella assembly 102 are generally aligned with the respective length and the height $H_{P1}$ of first face plate 104.

In one embodiment, when each lamella 132 includes porous material layer 140 (shown in FIG. 2) as first surface 134 (shown in FIG. 2) and metal layer 138 (shown in FIG. 2) as second surface 136 (shown in FIG. 2), or vice versa, lamellae 132 are layered onto first face plate 104 such that first surface 134 of lamella 132 is in contact with second surface 136 of an adjacent lamella 132. As such, metal layers 138 and porous material layers 140 of lamellae 132 alternate to form lamella assembly 102. Alternatively, when first and second surfaces 134 and 136 of each lamella 132 are metal layers 138, metal layer 138 is in contact with an adjacent metal layer 138 and porous material 140 is coupled between first and second surfaces 134 and 136. Referring briefly to FIG. 4, for example, when ACP is used as lamellae 132, adjacent skins 304 are in contact to form a metal layer 138, and foam core 302 is coupled between skins 304 to form porous material layer 140.

Referring again to FIGS. 2 and 5, second face plate 106 is, in the exemplary embodiment, positioned 508 on lamella assembly 102, which includes M lamellae 132 positioned on first face plate 104. More specifically, the length and the height $H_{P2}$ of second face plate 106 are generally aligned with the respective length and the height $H_L$ of lamella assembly 102 and/or the respective length and the height $H_{P1}$ of first face plate 104. Second face plate 106 is then coupled 510 to first face plate 104 and/or lamella assembly 102 such that lamellae 132 conform to the profile of first and second face plates 104 and 106. More specifically, clamps 116 are coupled to first face plate 104 and/or second face plate 106 at each corner 142 (two corners 142 are shown in FIG. 2) of secondary collimator 100 and/or 200 and apply pressure forces to first face plate 104 and/or second face plate 106. When pressure forces are applied to first face plate 104 and/or second face plate 106, lamellae 132 of lamella assembly 102 deform to the predetermined profile of first face plate 104 and second face plate 106 while metal layers 138 remain substantially parallel to each other, porous material layers 140, and first face plate 104 and second face plate 106. An assembled secondary collimator 100 and/or 200 may be coupled into XDI system 10 such that XDI system 10 functions as described herein.

The above-described embodiments facilitate collimating scattered radiation within an X-ray diffraction imaging (XDI) system. More specifically, the above-described secondary collimator facilitates using any size detector array within the XDI system because the secondary collimator may be fabricated to include any number of lamellae. For example, the above-described secondary collimator facilitates using a detector array having more than fourteen (14) detector elements with the XDI system. Furthermore, the secondary collimator facilitates the selection of scatter rays of radiation from varying depths in luggage, baggage, cargo, and/or other containers to image scatter rays onto a segmented detector array. Accordingly, the secondary collimator facilitates measuring energy-dispersive diffraction profiles at constant scatter angle in a depth-resolved (tomographic) system.

Moreover, because the above-described secondary collimator may be fabricated using ACP and/or other industry-standard materials, the time and/or cost of fabricating the secondary collimator is reduced, as compared to fabrication of known tungsten alloy collimators having a plurality of slits defined therethrough. Furthermore, the above-described porous material layer coupled between metal layers provides strength to the secondary collimator and facilitates ensuring that the metal layers are substantially parallel throughout the secondary collimator. Because the metal layers and porous material layers are thin and flexible, the above-described secondary collimator may be formed to any desired profile.

Additionally, the face plates facilitate securing the lamella in position within the secondary collimator through friction forces resulting from the pressure applied to the lamella assembly by the face plates. The face plates also facilitate determining the geometrical form and/or profile of the lamella assembly because the above-described lamellae can be easily and arbitrarily deformed when pressure is applied thereto. Furthermore, the above-described method of fabrication facilitates ensuring high parallelism among the metal layers, thus facilitating achieving high transmission through the above-described secondary collimator. Accordingly, the above-described methods and apparatus provide a secondary collimator that is more precise, less expensive, and has more design flexibility to allow an arbitrary number of detection elements to be employed, as compared to known secondary collimators that include a plurality of slits.

Exemplary embodiments of a secondary collimator and a method for assembling the same are described above in detail. The method and secondary collimator are not limited to the specific embodiments described herein. For example, the secondary collimator may also be used in combination with other inspection/detection systems and/or inspection methods, and is not limited to practice with only the XDI system as described herein.

While various embodiments of the invention have been described, those skilled in the art will recognize that modifications of these various embodiments of the invention can be practiced within the spirit and scope of the claims.

What is claimed is:

1. A method for assembling a secondary collimator including a first face plate having a first surface and an opposing second surface, said method comprising:

positioning a lamella assembly on the first face plate, wherein the lamella assembly includes at least one radiation-absorbing material layer and at least one radiation-transmitting material layer such that a first surface of the lamella assembly is adjacent the second surface of the first face plate; and coupling a second face plate to the first face plate and the lamella assembly such that a first surface of the second face plate is adjacent a second surface of the lamella assembly.

2. A method in accordance with claim 1, further comprising fabricating at least the second surface of the first face plate within about 10 μm of a predetermined profile.

3. A method in accordance with claim 1, wherein positioning a lamella assembly on the first face plate further comprises positioning the lamella assembly on a substantially planar first face plate.

4. A method in accordance with claim 1, wherein positioning a lamella assembly on the first face plate further comprises positioning the lamella assembly on a first face plate having an at least partially non-planar profile.

5. A method in accordance with claim 1, wherein positioning a lamella assembly on the first face plate further comprises positioning the lamella assembly on the first face plate such that the first surface and the second surface of the lamella assembly are substantially parallel to the second surface of the first face plate.

6. A method in accordance with claim 1, wherein positioning a lamella assembly on the first face plate further comprises positioning a first lamella on the second surface of the first face plate and positioning a second lamella on the first lamella, wherein each lamella includes at least one radiation-absorbing material layer and at least one radiation-transmitting material layer.

7. A method in accordance with claim 1, wherein coupling a second face plate to the first face plate and the lamella assembly further comprises coupling the second face plate to the first face plate and the lamella assembly using a mechanical fastening mechanism.

8. A secondary collimator, comprising:

a first face plate;

a second face plate; and a lamella assembly coupled between said first face plate and said second face plate, said lamella assembly comprising at least one lamella, each said lamella comprising at least one radiation-absorbing material layer and at least one radiation-transmitting material layer.

9. A secondary collimator in accordance with claim 8, wherein said lamella assembly comprises a plurality of lamellae, wherein said at least one radiation-absorbing material layer comprises a porous material and said at least one radiation-transmitting material layer comprises a metal layer.

10. A secondary collimator in accordance with claim 8, wherein said first face plate comprises a first surface and a second surface and said lamella assembly comprises a first surface and a second surface, said first surface of said lamella assembly substantially parallel to at least said second surface of said first face plate.

11. A secondary collimator in accordance with claim 8, wherein said first face plate is substantially planar.

12. A secondary collimator in accordance with claim 8, wherein said first face plate is at least partially non-planar.

13. A secondary collimator in accordance with claim 8, wherein said lamella assembly further comprises a plurality of substantially parallel aluminum composite panels.

14. An X-ray diffraction imaging (XDI) system, comprising:

an X-ray source;

a detector array comprising a plurality of detector elements; and a secondary collimator coupled between said X-ray source and said detector array, said secondary collimator comprising:

a first face plate;

a second face plate; and a lamella assembly coupled between said first face plate and said second face plate, said lamella assembly comprising at least one lamella, each said lamella comprising at least one radiation-absorbing material layer and at least one radiation-transmitting material layer.

15. An XDI system in accordance with claim 14, further comprising an examination area defined between said X-ray source and said secondary collimator.

16. An XDI system in accordance with claim 14, wherein said X-ray source comprises a multi-focus X-ray source.

17. An XDI system in accordance with claim 14, wherein said lamella assembly further comprises a plurality of lamellae, wherein said at least one radiation-absorbing material layer comprises a porous material and said at least one radiation-transmitting material layer comprises a metal layer.

18. An XDI system in accordance with claim 17, wherein a number of lamellae is equal to a number of channels of said detector array.

19. An XDI system in accordance with claim 14, wherein said secondary collimator has a substantially planar profile.

20. An XDI system in accordance with claim 14, wherein said secondary collimator has an at least partially non-planar profile.

* * * * *